United States Patent [19]

Rodgers

[11] 4,341,537

[45] Jul. 27, 1982

[54] SHORTING AND TEST MECHANISM FOR ELECTROSTATIC AIR CLEANER

[75] Inventor: Larry C. Rodgers, Circle Pines, Minn.

[73] Assignee: Honeywell Inc., Minneapolis, Minn.

[21] Appl. No.: 251,847

[22] Filed: Apr. 8, 1981

[51] Int. Cl.[3] ..... B03C 3/02

[52] U.S. Cl. ..... 55/139; 323/903; 55/274

[58] Field of Search ..... 55/139, 360, 274; 323/903; 174/6, 5 SG

[56] References Cited

U.S. PATENT DOCUMENTS

| | | | |
|---|---|---|---|
| 1,652,116 | 12/1927 | Gosslar | 174/5 SG |
| 3,188,674 | 6/1965 | Nodolf . | |
| 3,237,383 | 3/1966 | Gilbertson | 55/139 |
| 3,504,482 | 4/1970 | Goettl . | |
| 3,513,634 | 5/1970 | Angonese et al. | 55/139 |
| 3,630,000 | 12/1971 | Mullings . | |
| 3,733,783 | 5/1973 | Barney | 55/139 |
| 4,127,888 | 11/1978 | Epstein . | |

*Primary Examiner*—Bernard Nozick
*Attorney, Agent, or Firm*—Lockwood D. Burton; Mitchell J. Halista

[57] ABSTRACT

A shorting and test mechanism for an electrostatic air cleaner uses an electrically conductive spring element attached to an access door to the air cleaner whereby an opening movement of the door effects a motion of the spring to contact the high voltage electrode support assembly to discharge any residual electrical charge on the high voltage assembly to ground. Conversely, the closing of the access door forces the spring away from the high voltage electrode assembly to permit a normal operation of the air cleaner. The spring is further connected to an electrically insulating test button located in an opening in the access door to induce by an operator a selective motion of the spring toward the high voltage electrode assembly whereby to test for the existence of the high voltage on the electrode assembly by providing an electrical arc path to ground through the spring when the test button is depressed.

3 Claims, 3 Drawing Figures

SHORTING AND TEST MECHANISM FOR ELECTROSTATIC AIR CLEANER

BACKGROUND OF THE INVENTION

1. Field of the Invention

The present invention relates to electrostatic air cleaners. More specifically, the present invention is directed to a shorting and test mechanism for an electrostatic air cleaner or precipitator.

2. Description of the Prior Art

In electrostatic air cleaning or precipitator systems of the known type designed particularly for residential use, the ionizing and collector electrodes are located in a forced air heating system with electrical power control means for enabling the periodic deenergization of the electrostatic cleaning system so that any dust particles removed from the air stream and accumulated on the collecting electrodes may be removed. Since the ionizing and collecting electrodes of electrostatic air cleaning systems are normally maintained at a relatively high potential, it is necessary for safety reasons to insure that the operator, e.g., a home owner, cannot come in contact with this high voltage. Devices for deenergizing the high voltage system include access door operated switches which automatically short-circuit the high voltage circuit upon the opening of the access door to effectively remove the high voltage from the ionizing and collector electrodes, e.g., the system shown in U.S. Pat. No. 3,188,784. Additionally, while those devices for de-energizing the high voltage supply to the ionizing and collector electrodes are well-known in the art, there exists a need for removing any residual charge which may be present on the ionizing and collecting electrodes to prevent injury during the cleaning of the electrodes. Further, a test means for providing an audible signal to an operator that is indicative of the proper operation of the electrostatic air cleaner, i.e., indicative of the presence of a high voltage on the ionizing and collector electrodes, is desirable to enable the operator to easily and safely ascertain whether or not the system is actually functioning. Accordingly, it is advantageous to provide a mechanism for removing the residual charge on the collector and ionizing electrodes after the high voltage power supply has been deenergized in order to prevent injury during the cleaning of the collector electrodes and for providing a means for safely testing the operation of the electrostatic precipitator by generating a noticeable signal indicative of the proper operation thereof.

SUMMARY OF THE INVENTION

Accordingly, an object of the present invention is to provide an improved electrostatic precipitator having a high voltage shorting and test mechanism.

In accomplishing this and other objects, there has been provided, in combination with an electrostatic precipitator, a shorting and test mechanism including an electrically conductive cantilever spring having one end attached to a precipitator access door and a spring pivot bearing on an electrically grounded electrode housing with a motion of the spring induced by an opening of the access door being arranged to short-circuit a high voltage electrode to an electrical ground and further having a test button penetrating the access door for enabling a selective urging of the spring toward the high voltage electrode to induce an electrical arc therebetween whereby an audible indication is produced representative of the operation of the electrostatic precipitator.

BRIEF DESCRIPTION OF THE DRAWING

A better understanding of the present invention may be had when the following detailed description is read in connection with the accompanying drawings, in which.

DESCRIPTION OF THE PREFERRED EMBODIMENT

Detailed Description

Figure 1:
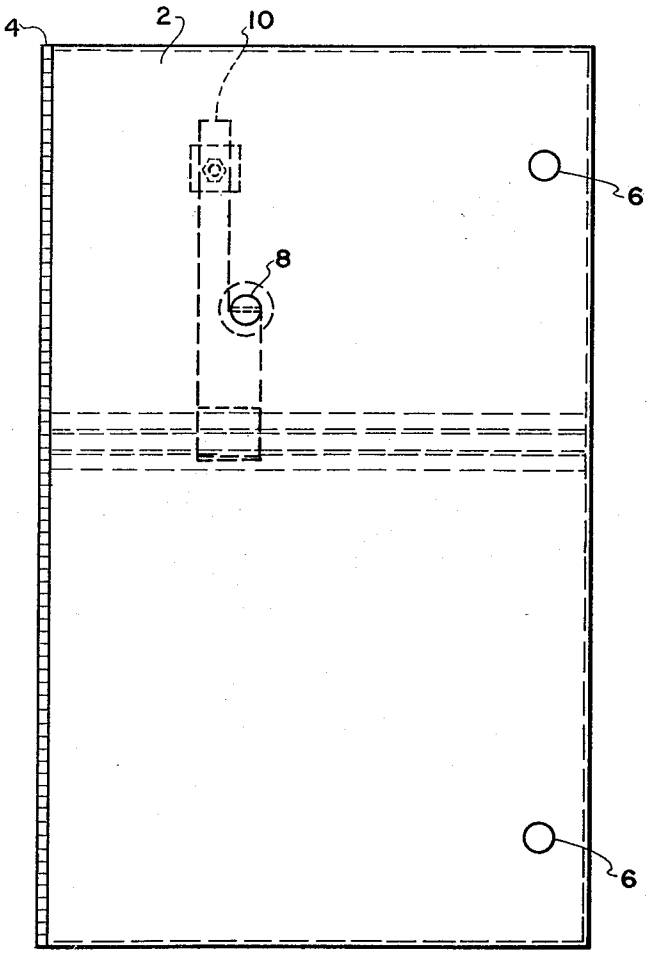
FIG. 1 is a front view of an access door of an electrostatic precipitator showing the relative location of an example of a shorting and test mechanism embodying the present invention.

Referring to FIG. 1 is more detail, there is shown a front view of an access door 2 to an electrostatic precipitator (not shown). The access door 2 includes a hinge 4 located along one side of the access door 2. A pair of handles 6 are provided on the access door 2 to enable the access door 2 to be rotated on the hinge 4. An electrically insulating test button 8 is located within an opening through the door 2 to enable the test button 8 to penetrate through the door 2 and to project from the face of the door 2. The test button 8 is connected to a portion of one end of an electrically conductive cantilever spring 10 which has its other end attached to the access door 2 to function as part of a shorting and test mechanism as described more fully hereinafter.

Figure 2:
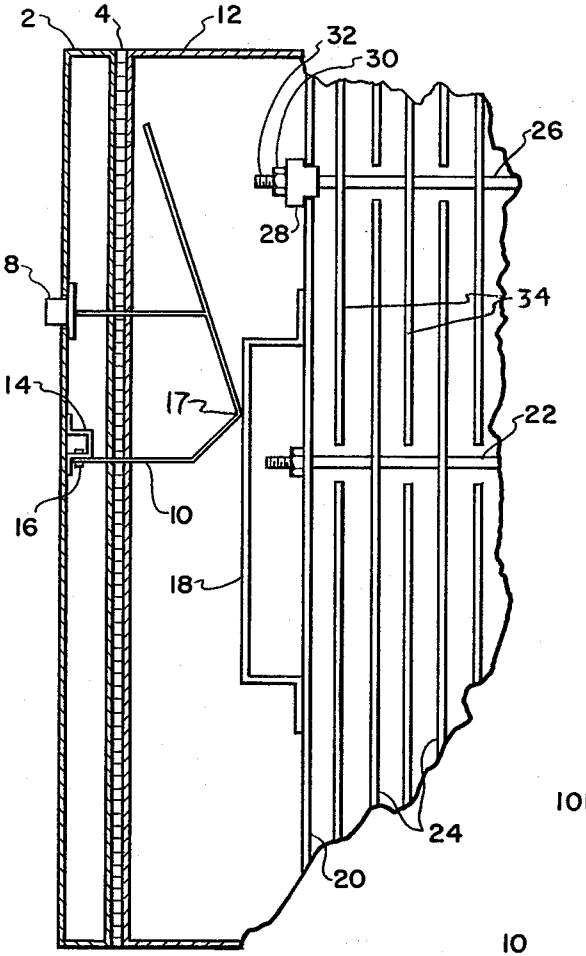
FIG. 2 is a partial cross-section of an electrostatic precipitator including the access door shown in FIG. 1

Referring to FIG. 2, there is shown a partial cross-sectional illustration of electrostatic precipitator and a shorting and test mechanism embodying an example of the present invention in a side view of FIG. 1. Similar reference numbers have been used in FIGS. 1 and 2 to indicate similar structural elements. The access door 2 is hinged by the hinge 4 on an electrostatic precipitator housing 12. The shorting and test mechanism spring 10 is attached by any suitable means, e.g., rivets 16, to a transverse rib 14 affixed to the interior surface of the access door 2. The spring 10 is arranged to have a pivot contact 17 intermediate its ends and facing a forwardly projecting extension 18 attached to an electrically grounded frame 20 within the electrostatic precipitator.

A ground potential support rod 22 is directly attached to the cell frame 20 to provide a support for a plurality of ground potential plates or electrodes 24. A high voltage support rod 26 is spaced from the ground rod 22 and is electrically insulated from the cell frame 20 by an electrically insulating support bushing 28. The rod 26 is attached to the bushing 28 by a nut 30 located on a threaded end 32 of the rod 26 extending through the bushing 28. A plurality of high voltage electrodes or plates 34 are mounted on the high voltage rod 28 and are interleaved between the ground potential electrodes 24 and spaced therefrom.

Figure 3:
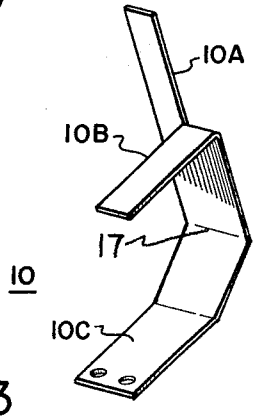
FIG. 3 is a pictorial illustration of the cantilever spring used in the example of the shorting and test mechanism shown in FIGS. 1 and 2.

As shown in FIG. 3, the electrically conductive cantilever spring 10 has a bifurcated first end with a first projecting end extension or finger 10A which is arranged to contact the threaded end 32 of the rod 26 during the initial opening of the access door 2. A second extension or finger 108 of the first end of the spring 10 is bent at an angle with respect to the first finger 10A which enables the end of the extension 10B to be contacted by the pushbutton 8. The extensions 10A and 10B are longitudinal segments of a main body 10C of the spring 10 with the second end of the spring 10, i.e., the end of the main body 10C, being adapted to be fastened to the rib 14 on the door 2. The spring pivot 17 is located intermediate the bifurcated end of the spring 10 including the fingers 10A and 10B and the main body 10C of the spring 10. The spring 10 may be of any suitable material to provide flexibility and electrical conductivity, e.g, phosphor bronze.

In operation, the shorting and test mechanism is effective to provide a noticeable signal to an operator of the operation of the high voltage supply of the electrostatic precipitator by providing a selective electrical arc path to ground for the high voltage on the high voltage electrodes 34. Specifically, the actuation, i.e., depression, of the test button 8 by an operator forces the electrically conductive spring 10 to pivot on pivot 17 by urging the second finger 10B in contact with the button 8 toward the extension 18. This motion of the spring 10 is effective to position the end of the first finger 10A adjacent to the threaded end 32 of the rod 26. Upon the attainment of a short distance between the first finger 10A and the end 32, the high voltage on the rod 26 is effective to establish an electrical arc therebetween via the spring 10 and the pivot 17 contacting the grounded extension 18 since the test operation is performed during the actual operation of the precipitator. The sound of the electrical arc provides a noticeable signal to an operator that the high voltage is present on the high voltage electrodes 34 while the electrically insulating test button 8 provides electrical isolation between the operator and the high voltage within the precipitator. It should be noted that the aforesaid test operation induces a transverse motion of the pivot 17 on the extension 18 whereby the surface of the extension 18 contacted by the pivot 17 is wiped clean for each test operation to assure a good electrical contact between the pivot 17 and the grounded extension 18. Conversely, the first end 10A is maintained in a non-arcing spaced relationship with respect to the end 32 of the rod 26 between operations of the test button 8 by the closed position of the access door 2 which induces the spring 10 to pivot on the pivot 17 to position the spring fingers 10A and 10B in the illustrated position in FIG. 2.

The opening of the access door 2 prior to an electrode cleaning operation by an operator, on the other hand, is effective to relieve the aforesaid door pressure on the pivot 17 to allow the first finger 10A to contact end 32 of the rod 26 since the normal unbiased position of the first finger 10A is a position providing a mechanical contact with the end 32 of the rod 26. This contact, which allows an extremely rapid low resistance discharge of any residual charge on the electrodes 34 is of a transitory nature since the opening of the access door 2 will ultimately carry the spring 10 away from the extension 18 of the electrode housing 20. Since the access door 2 would also be coupled to a conventional high voltage circuit interrupting device (not shown), the concurrent deenergization of the high voltage is effective to provide the primary safety apparatus while the shorting mechanism of the present invention provides a rapid discharge of the residual electrical charge on the high voltage plates 34 during the opening of the access door 2 before the electrode plates 34 are fully exposed for the cleaning operation. The opening of the access door 2 will also induce a wiping action of the pivot 17 on the extension 18 to assure electrical contact therebetween.

Accordingly, it may be seen, that there has been provided, in accordance with the present invention an improved electrostatic precipitator having a shorting and test mechanism.

The embodiments of the invention in which an exclusive property or privilege is claimed are defined as follows:

1. In an electrostatic air cleaner including first collector electrodes, second collector electrodes, a high voltage supply connected to said first and second collector electrodes for producing an electrostatic charge therebetween with said first collector electrodes being held at a high potential and said second collector electrodes being held at a ground potential, electrically grounded housing enclosing and spaced from said first and second collector electrodes while allowing an air flow thereacross and an access door attached to said housing for affording access to the electrodes for cleaning the electrodes, the improvement comprising electrically conductive shorting means attached to an inner surface of said access door for providing a transient contact with said first collector electrodes during an opening operation of said access door and selectively operable test means penetrating said access door and attached to said shorting means for urging said shorting means into contact with said first electrodes, wherein said shorting means includes an electrically conductive one piece cantilever spring having one end connected to said access door, a pivot spaced from said one end of said spring and bearing on an interior grounded surface in said housing during a closed position of said access door and an opening operation of said access door and a bifurcated second end having a first extension attached to said test means and a second extension normally spaced from said first electrodes at a distance prohibiting an electrical arc during a closed position of said access door while contacting said first electrodes during an opening operation of said access door, said test means including an electrically insulating pushbutton means connected to said first extension of said shorting means and extending through said access door.

2. In an electrostatic air cleaner as set forth in claim 1 wherein said spring is made of phosphor bronze.

3. In an electrostatic air cleaner as set forth in claim 1 wherein said pushbutton means has a travel distance with respect to said access door to selectively position said second extension of said spring at an electrical arc distance with respect to said electrodes.

* * * * *